US011047644B2

(12) United States Patent
Shearer

(10) Patent No.: US 11,047,644 B2
(45) Date of Patent: Jun. 29, 2021

(54) DUTY MOUNT

(71) Applicant: Tedder Industries, LLC, Post Falls, ID (US)

(72) Inventor: Jacob Shearer, Post Falls, ID (US)

( * ) Notice: Subject to any disclaimer, the term of this patent is extended or adjusted under 35 U.S.C. 154(b) by 0 days.

(21) Appl. No.: 16/817,994

(22) Filed: Mar. 13, 2020

(65) Prior Publication Data

US 2020/0292273 A1 Sep. 17, 2020

Related U.S. Application Data

(60) Provisional application No. 62/819,258, filed on Mar. 15, 2019.

(51) Int. Cl.
*F41C 33/04* (2006.01)
*F41C 33/02* (2006.01)

(52) U.S. Cl.
CPC ..... *F41C 33/041* (2013.01); *F41C 33/0263* (2013.01)

(58) Field of Classification Search
CPC .... F41C 33/045; F41C 33/041; F41C 33/043; F41C 33/0263; F41C 33/0209; A45F 5/021; A45F 5/02; A45F 2005/026; A45F 2005/025; F16N 11/041; F16N 13/022
USPC ..... 224/197, 271, 272; 248/221.11, 220.21, 248/223.41
See application file for complete search history.

(56) References Cited

U.S. PATENT DOCUMENTS 5,850,996 A * 12/1998 Liang ..... A45F 5/02 248/221.11
6,098,858 A * 8/2000 Laugesen ..... A45F 5/02 224/197
6,286,737 B1 * 9/2001 Whitley ..... H04M 1/04 224/196
6,786,372 B2 * 9/2004 Enkerlin ..... A45F 5/02 224/196
8,613,564 B2 * 12/2013 Busch ..... F41C 33/007 403/322.1
8,919,623 B1 * 12/2014 Bergeron ..... A45F 5/021 224/148.4
10,165,851 B1 * 1/2019 Downs ..... A45F 5/021
10,222,172 B2 * 3/2019 Melville ..... F41C 33/041
10,271,634 B1 * 4/2019 Eynav ..... A44B 17/0011

* cited by examiner

*Primary Examiner* — Corey N Skurdal

(57) ABSTRACT

Representative implementations of devices and techniques provide duty mount assembly to mount and to support an implement (such as a handgun, for example) or an implement holster (such as a handgun holster, for example), or the like, in a variety of configurations. The duty mount assembly comprises a receiver with a receiver pocket and an adapter configured to securely fit within the receiver pocket. The adapter may be coupled to the implement or the implement holster.

20 Claims, 9 Drawing Sheets

DUTY MOUNT

PRIORITY CLAIM AND CROSS-REFERENCE TO RELATED APPLICATION

This application claims the benefit under 35 U.S.C. § 119(e)(1) of U.S. Provisional Application No. 62/819,258, filed Mar. 15, 2019, which is hereby incorporated by reference in its entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

A carrier may be worn on a person for convenience of the user. In some examples, the carrier may be coupled to an item of the user's clothing, such as to a belt or the waistband of trousers, for instance. In other examples, the carrier may be coupled to an accessory item, such as to a strap or a harness worn on the back or shoulders of the user, or worn on a leg of the user. Further, the carrier may be coupled to a utility pack or bag, it may be coupled to an item of tactical gear, or to various other locations on the person.

However, it may not be desirable for the user to wear the implement and holster at all times. For example, it may be desirable to move the implement and holster from a worn position on the user to a temporary location not on the user's person for a time (such as when driving an automobile, sitting at a desk, sleeping in a bed, etc.), and still have ready and convenient access to the implement.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
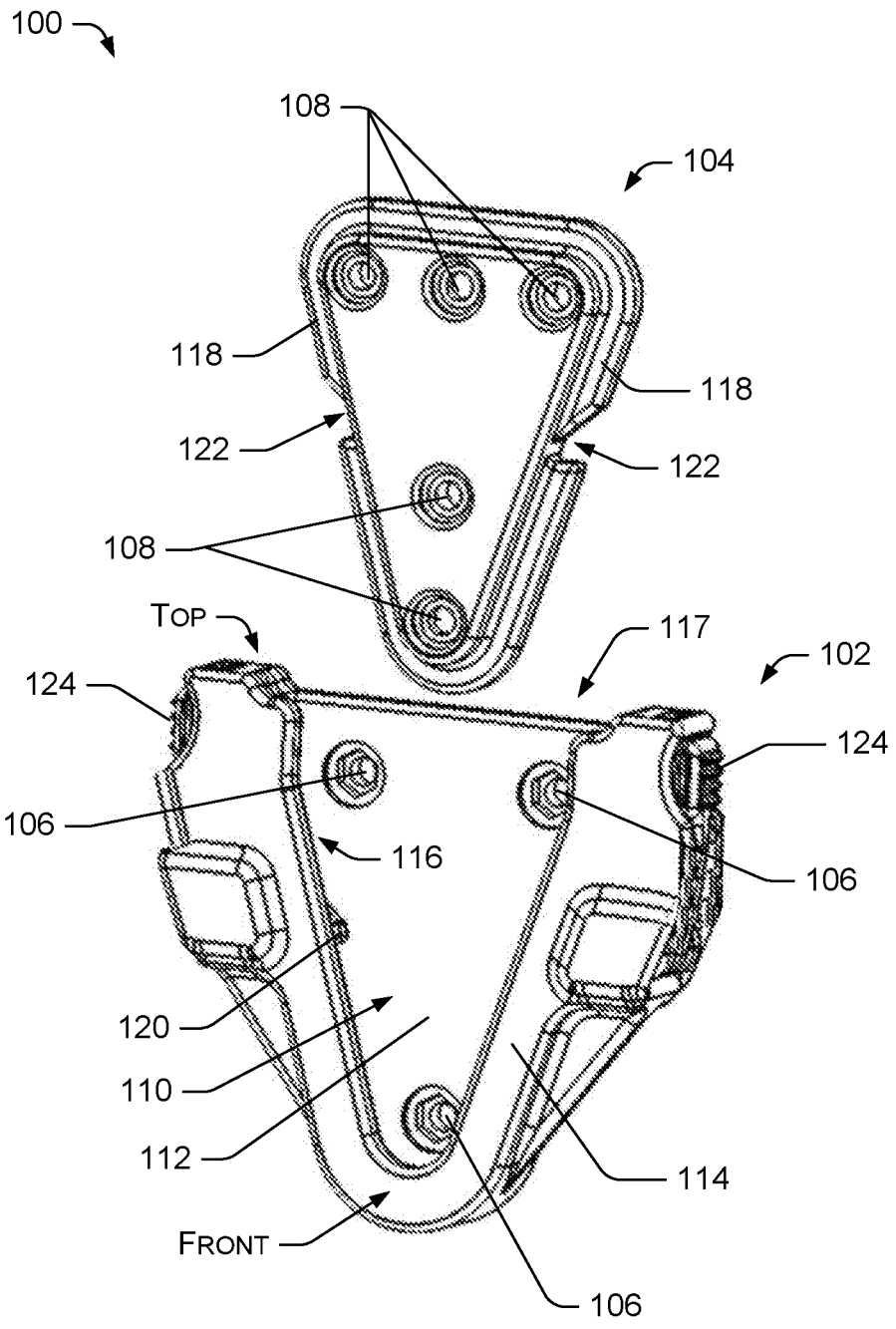
FIG. 1 shows a perspective view of an example duty mount assembly, including an adapter and a receiver, according to an implementation.

Representative implementations of devices and techniques provide a duty mount assembly to mount and to support an implement (such as a handgun, for example) or an implement holster (such as a handgun holster, for example), or the like, in a variety of configurations. The duty mount assembly is arranged to be mounted in various locations for temporarily and safely mounting the implement, while making the implement easily accessible to the user.

In some examples, the duty mount assembly may be mounted to user-wearable supports for carrying the implement. For example, a portion of the duty mount assembly (the adapter, for instance) may be mounted to a handgun holster and another portion of the duty mount assembly (the receiver, for instance) may be mounted to (or integral with) a wearable device, such as a paddle, a belt slide, etc., that may be worn by a user (e.g., on a user's belt, waistband, shoulder rig, ankle rig, etc.). The duty mount assembly can couple the holster to the paddle, belt slide, or the like, for carrying the holster (in an outside-the-waistband (OWB) configuration, for example). Alternately, the receiver may be mounted directly to a tool belt, gun belt, shoulder rig, ankle rig, or other wearable item or accessory.

In another example, the receiver for instance, may be mounted (using one or more mounting holes) to a convenient surface, such as within a vehicle, on a portion of a desk or other furniture, on a bedframe, on a portion of a wall, or the like, either within view or concealed from view. The receiver may be removed from one location and mounted to another location if desired, or multiple receivers may be mounted at various locations. Another portion of the duty mount assembly (the adapter, for instance) may be mounted to a handgun holster. The duty mount assembly can couple the holster to the convenient surface, within the vehicle, on a desk or other furniture, on a bedframe, on a portion of a wall, or the like, for storing or mounting the holster.

In various implementations, a user can remove the implement or implement holster from their person, and mount the implement or implement holster to a receiver (using an adapter coupled to the implement or implement holster) for temporary storage with easy access. For example, when preparing to use a vehicle, the user may remove a holster from a receiver on the user's person, and mount the holster to a receiver located inside the vehicle. The receiver may be coupled to the vehicle in a convenient location, within easy reach of the user while in the vehicle. The user can easily and quickly dismount the implement or implement holster from the receiver in the vehicle and mount it to a receiver on their person when desired (such as when leaving the vehicle). Alternately, the user can withdraw the implement from the holster for use while the holster remains mounted to the receiver within the vehicle. The implement may be returned to the holster while the holster is mounted to the receiver within the vehicle.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the duty mount components illustrated in the figures may vary to accommodate the various objects to be docked, as well as to accommodate various applications. In alternate embodiments, fewer, additional, or alternate components may be used and/or combined to form a duty mount assembly having an equivalent function and operation.

Implementations are explained in more detail below using a plurality of examples. Although various implementations and examples are discussed here and below, further implementations and examples may be possible by combining the features and elements of individual implementations and examples.

Example Duty Mount

An example duty mount assembly ("mount") 100, as shown in FIGS. 1-12, allows for a carrier (such as an implement or an implement holster, for example) to be mounted to an article of clothing, a user accessory, a wall or other surface using a receiver component 102 and an adapter component 104, for example, which are components of the mount 100. In various implementations, the receiver 102 is arranged to be temporarily or permanently fixed to an article (e.g., an article of clothing, a user accessory, a belt, a strap, etc.) or a convenient surface (e.g., a wall, vehicle console, desk, bed, etc.), as desired, using one or more mounting holes 106 in the receiver 102 and permanent or temporary fasteners.

The adapter 104 is arranged to be temporarily or permanently fixed to a carrier (e.g., a holster, a case, an enclosure, a sheath, etc.) which may be configured to hold an implement (e.g., a tool, a weapon, an instrument, etc.), or the like, using one or more mounting holes 108 in the adapter 104 and permanent or temporary fasteners. The adapter 104 may also be temporarily or permanently fixed to an implement. Alternately, the functional roles of the receiver 102 and the adapter 104 may be reversed—the receiver 102 may be configured to be coupled to a carrier and the adapter 104 may be configured to be coupled to an article or a convenient surface.

Referring to FIGS. 1-12, the receiver 102 may comprise a substantially planar hard mount component, or the like, having a receiver pocket 110. The back surface 112 of the receiver 102 (which can also comprise a back surface of the pocket 110) can be substantially planar. The receiver pocket 110 is formed by the presence of a frame 114 or lip around a portion of the planar back surface 112 of the receiver 102. The frame 114, comprises a built-up or raised portion that extends away from the back surface 112 of the receiver 102, forming a ledge or bench around the portion of the back surface 112. In some embodiments, the frame 114 includes a groove 116 along the inside edge of the frame 114 (as shown in FIG. 1). The interior area of the receiver 102 that is at least partially surrounded by the frame 114 comprises the pocket 110.

Figure 2:
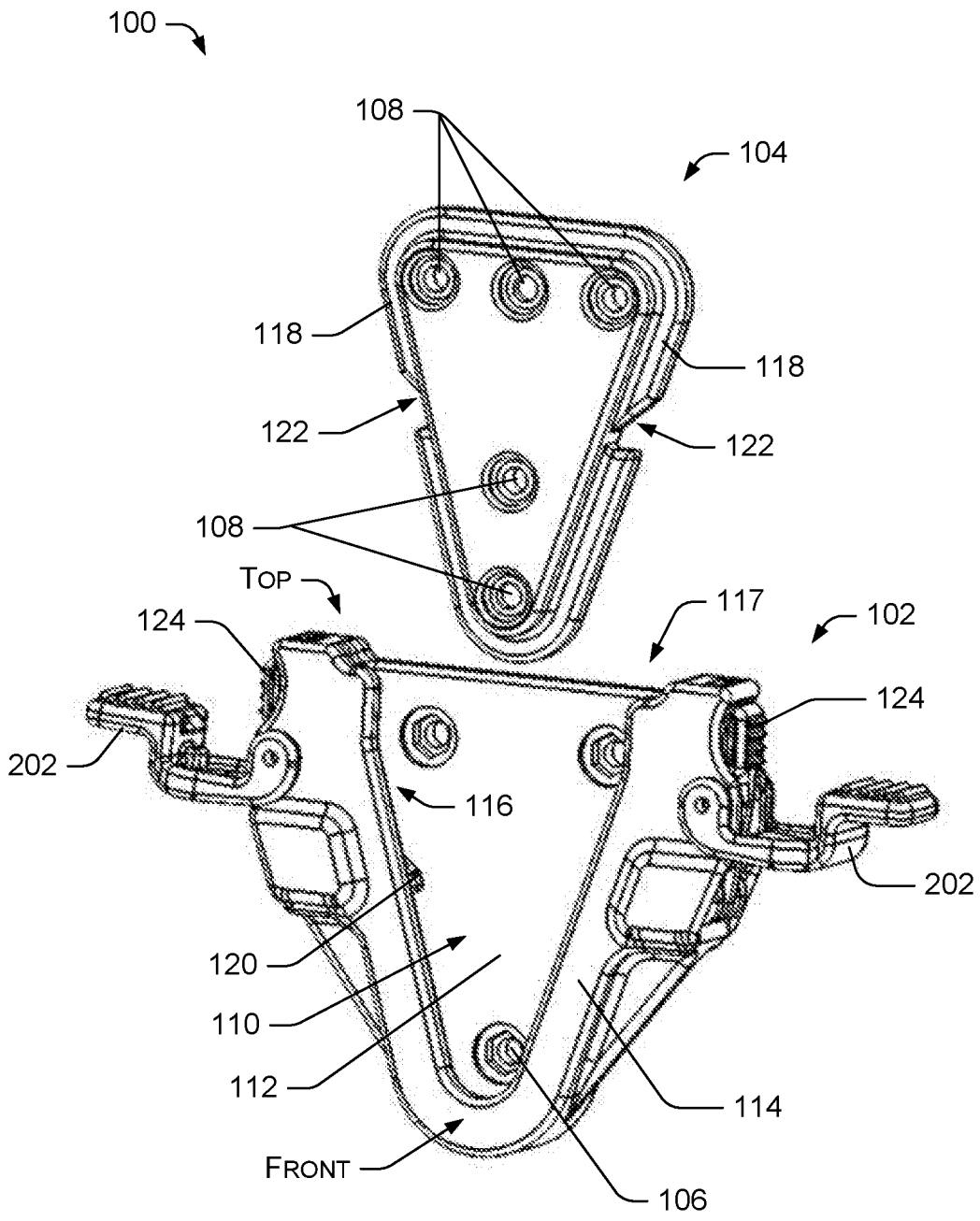
FIG. 2 shows a perspective view of an example duty mount assembly, including an adapter and a receiver with secondary locks, according to an implementation.
Figure 3:
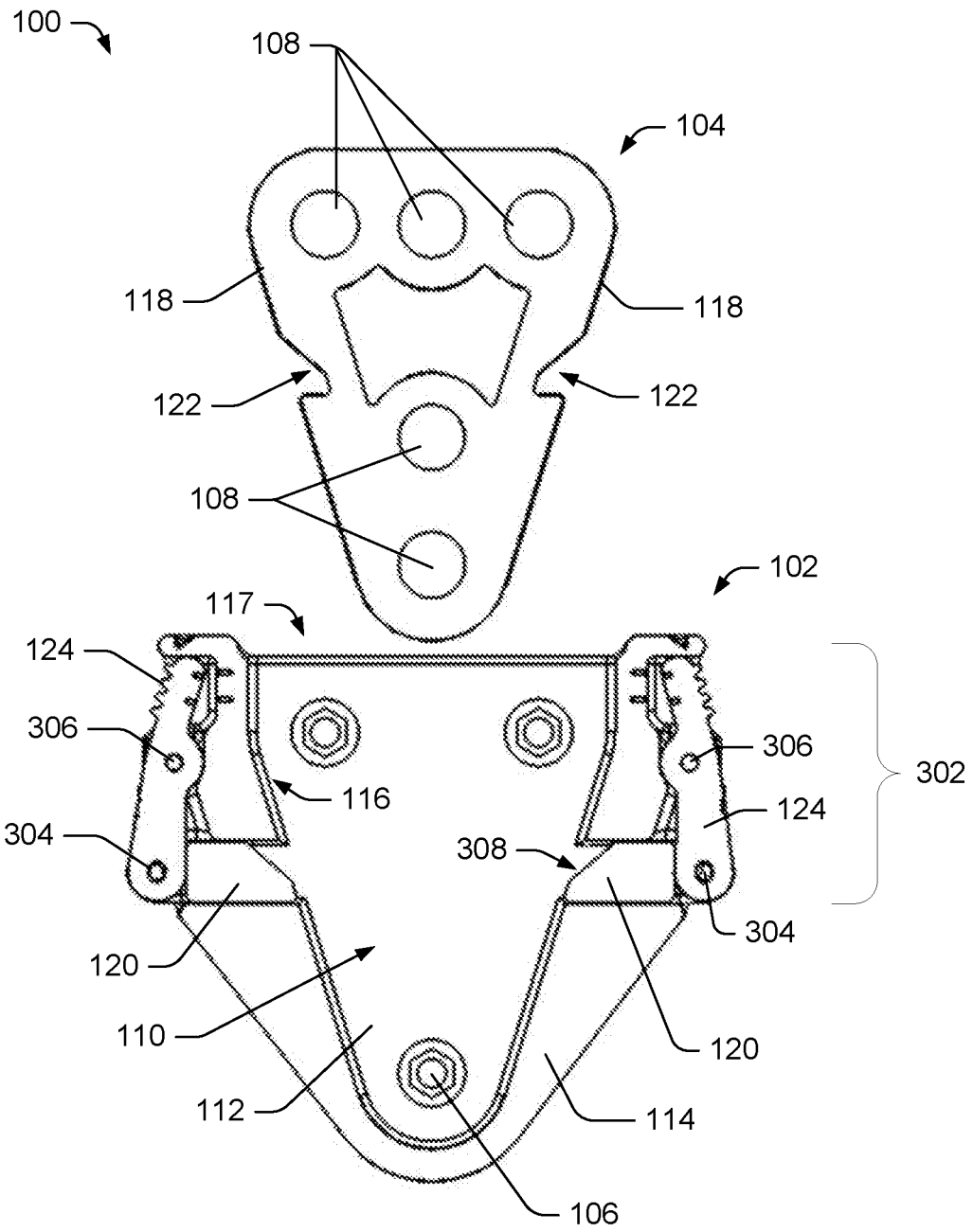
FIG. 3 shows a cross-section plan view of an example duty mount assembly, according to an implementation.
Figure 4:
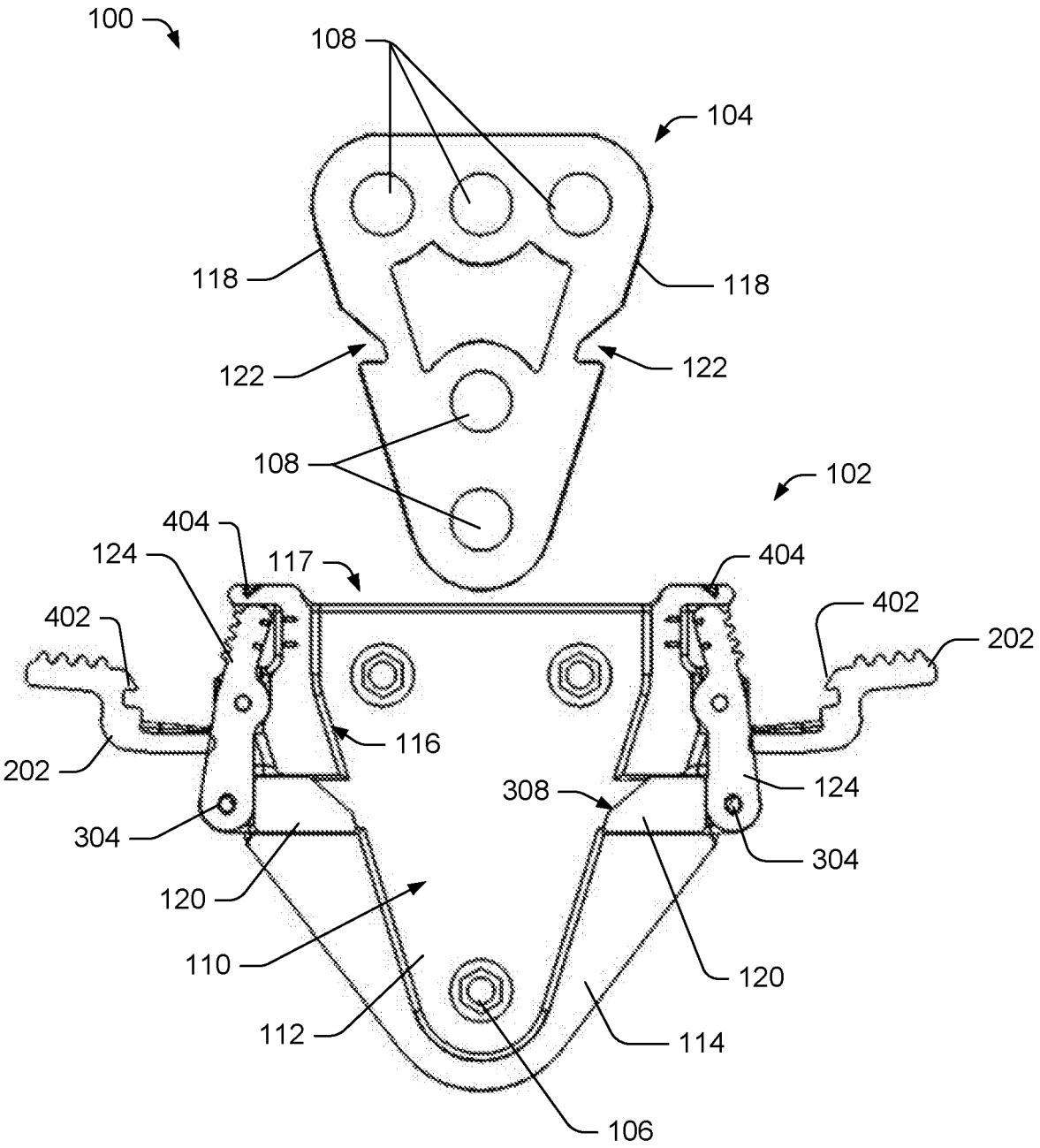
FIG. 4 shows a cross-section plan view of an example duty mount assembly with secondary locks, according to an implementation.

The receiver 102 is arranged to receive an adapter 104 at the pocket 110, and to support a carrier or an implement attached to the adapter 104. As illustrated at FIGS. 1 and 2, in some embodiments, the pocket 110 may have an area that is greater than half (a majority) of the area of the receiver 102. In various implementations, the adapter 104 may be coupled to the receiver 102 in multiple user-selected rotational orientations.

The constituents of the duty mount assembly 100 are removably coupled together by inserting the adapter 104 into the receiver pocket 110 of the receiver 102. As shown at FIG. 1, the receiver pocket 110 and the adapter 104 are configured to have the same perimeter shape or a near-same shape, for a secure fit without undue movement of the adapter 104 within the receiver pocket 110. While a triangular shape for the adapter 104 and the receiver pocket 110 is illustrated in the figures, other shapes (e.g., elliptical, polygonal, irregular, etc.) are also within the scope of the disclosure.

In some embodiments, the adapter 104 may be inserted into the receiver pocket 110 from the "front" of the receiver 102. For example, the perimeter of the adapter 104 may be lined up with the perimeter of the receiver pocket 110, and the adapter 104 pressed into the receiver pocket 110 until engaging with the receiver 102.

In other embodiments, the adapter 104 may be inserted into the receiver pocket 110 from the "top" of the receiver 102. For example, the frame 114 of the receiver 102 may be open or not present at the top portion of the receiver 102. This opening 117 in the frame 114 can be an opening to the pocket 110 for the adapter 104. The adapter 104 may be lined up with the receiver pocket 110, with the adapter 104 above the receiver 102 (as shown in FIG. 1, for example). The adapter 104 may be moved down through the opening 117 and into the receiver pocket 110 until fully engaging with the receiver 102.

In some embodiments, one or more edges of the adapter 104 engage with one or more portions of the groove 116 of the receiver pocket 110. For instance, the one or more edges of the adapter 104 may slide behind the one or more portions of the frame 114 when the adapter 104 is moved down into the receiver pocket 110, guided by the groove 116.

In various embodiments, the adapter 104 comprises a substantially planar component having a perimeter shape that is the same or nearly the same as the shape of the receiver pocket 110. For example, at least a majority (more than 50%) of the perimeter shape of the adapter 104 is the same as the perimeter shape of the receiver pocket 110. In an embodiment, the adapter 104 includes an adapter rim 118 around at least a portion of the perimeter edge of the adapter 104. The rim 118 may comprise a thinner edge than the thickness of the adapter 104. For instance, the rim 118 may have a thickness that matches (e.g., is substantially the same as) the thickness of the groove 116 of the receiver pocket 110.

The rim 118 may be configured to slide into the groove 116, which extends around at least a portion of the perimeter of the receiver pocket 110. For instance, the groove 116 can be a guide for the adapter 104 (and particularly the rim 118) to slide into place within the receiver pocket 110 to engage with the receiver 102. The groove 116 and the receiver frame 114 also provide added security, holding the adapter 104 in place within the receiver pocket 110.

Referring to FIGS. 1-8, in various embodiments, the adapter 104 can be locked into the receiver pocket 110 using one or more locking components. In some embodiments, a spring loaded, sliding, or otherwise operated catch mechanism 302 that traps the adapter 104 in the receiver pocket 110 is used. The catch mechanism 302 ensures that the adapter 104 remains in the receiver pocket 110 until intentionally released by a user.

In one example, as shown at FIGS. 1-8, the catch mechanism 302 includes a post 120, which is arranged to engage a portion of the adapter 104 when extended, preventing the adapter 104 from exiting the receiver 102, until intentionally released by the user. In an embodiment, the post 120 extends through an opening or hole in the frame 114, and into the receiver pocket 110. The post 120 may engage a feature 122 (such as a notch, or the like) at a portion of the adapter 104, for instance at the rim 118 of the adapter 104, as shown in FIGS. 1-8. In various embodiments, the shape of the feature 122 may match the shape of the end of the post 120, so that the post 120 engages the feature 112 in a secure manner.

Engaging the feature 122 or the portion of the adapter 104 blocks the adapter 104 from being removed from the receiver 102, trapping the adapter 104 in the receiver pocket 110. In some examples, the duty mount assembly 100 may include two or more catch mechanisms 302, engaging multiple features 122 of the adapter 104 to lock the adapter 104 into the receiver pocket 110.

The post 120 of the catch mechanism 302 may be operated using a user-operated actuator 124, for example. The actuator 124 can be a lever (as shown in FIGS. 3-8), with one or more pivot points (e.g., 304 and 306). For instance, the post 120 may be pivotally coupled (at the lower pivot 304) to the actuator 124 near an end of the actuator 124. Also, the actuator 124 may be pivotally coupled (at the upper pivot 306) to the body of the receiver 102 near a mid-point (or other mechanically advantageous point) on the actuator 124, for instance.

Figure 5:
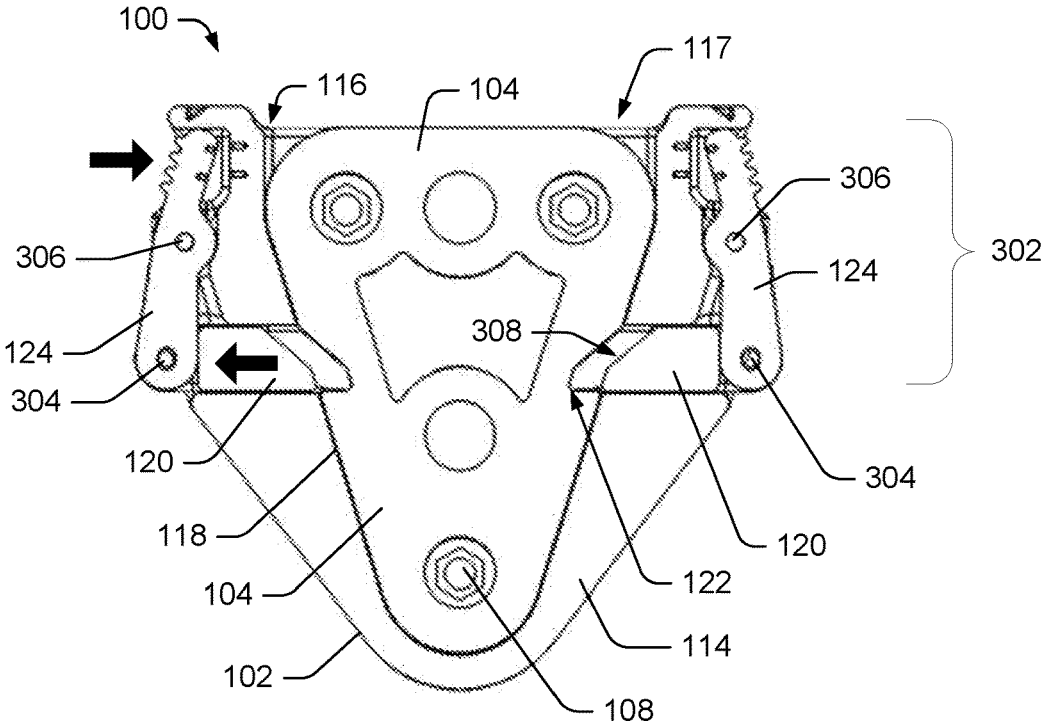
FIG. 5 shows a cross-section plan view of an example duty mount assembly in an unlocked configuration, according to an implementation.

As shown in FIG. 5, moving the actuator 124 a first direction retracts the post 120 away from the adapter 104 (e.g., the notch 122 of the adapter 104), disengaging from the adapter 104 and clearing the adapter 104, allowing the adapter 104 to be removed from the receiver pocket 110. The adapter 104 may also be inserted into the receiver pocket 110 with the post 120 retracted. This is the unlocked configuration of the catch mechanism 302, including the actuator 124 and the post 120.

In the example shown, moving the catch mechanism 302 into the unlocked configuration includes pressing on an upper portion of the actuator 124 (which may include a textured surface at the upper portion of the actuator 124 as an indication of an area to depress), which moves the upper portion of the actuator 124 toward the receiver 102 as the actuator 124 pivots on the upper pivot point 306. This rotation of the actuator 124 causes the lower portion of the actuator 124 to move away from the receiver 102, pulling the post 120 outward, at the lower pivot point 304. Consequently, the post 120 moves away (i.e., retracts) from the adapter 104, clearing the adapter 104.

Figure 6:
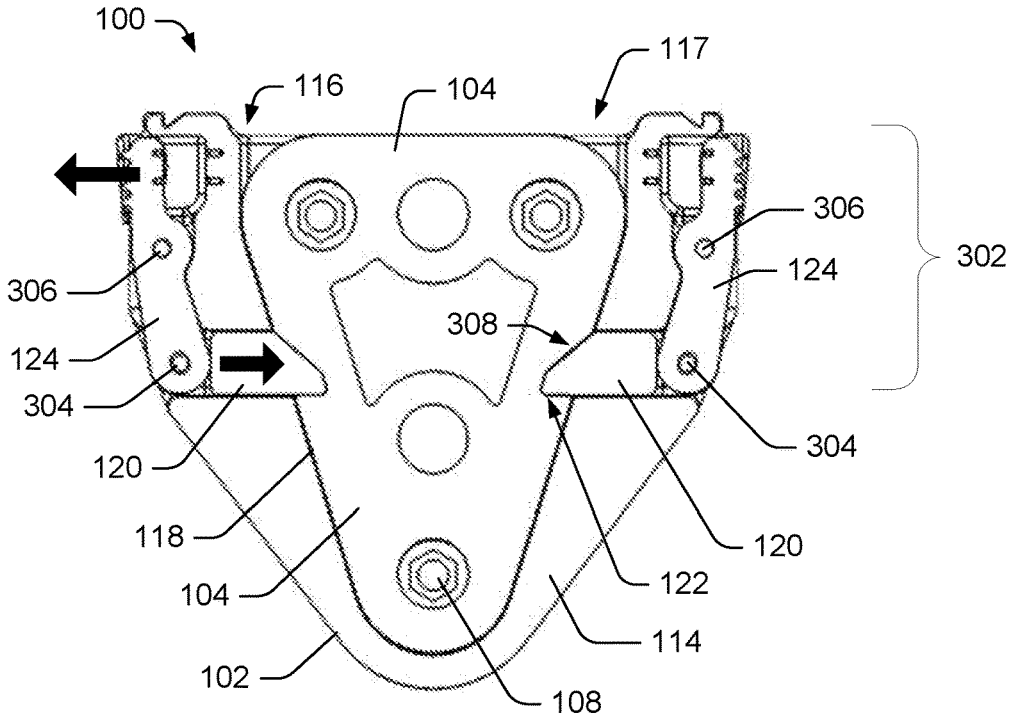
FIG. 6 shows a cross-section plan view of an example duty mount assembly in a locked configuration, according to an implementation.

As shown in FIG. 6, moving the actuator 124 a second direction extends the post 120, engaging the adapter 104 (e.g., the notch 122 of the adapter 104) with the post 120. The adapter 104 may not be removed from the receiver pocket 110 with the post 120 extended. This is the locked configuration of the catch mechanism 302, including the actuator 124 and the post 120.

In the example shown, moving the catch mechanism 302 into the locked configuration includes pivoting the actuator 124 on the upper pivot point 306 in an opposite direction and moving the upper portion of the actuator 124 away from the receiver 102. This rotation of the actuator 124 causes the lower portion of the actuator 124 to move toward the receiver 102 at the lower pivot point 304, and the post 120 moves toward the adapter 104 (i.e., extends), engaging the adapter 104.

In one example, the post 120 and/or the actuator 124 may be spring-loaded, biased, or the like, such that moving the actuator 124 in the first direction loads the spring, and the actuator 124 and post 120 moves in the second direction, into the locked configuration, when the spring tension is released (e.g., when the actuator lever 124 is released).

In an implementation, the post 120 may include a ramped portion 308, for instance, so that the adapter 104 can be inserted into the receiver 102 while in the locked configuration. For example, moving the adapter 104 against the ramped portion 308 (while the post 120 is extended) causes the post 120 to be moved out of the way of the adapter 104 (retracts the post 120), and puts the spring device (if present) of the post 120 into tension, until the adapter 104 is fully within the receiver pocket 110. The spring-action of the post 120 (or a manual action by the user on the actuator 124) can move the post 120 back into its extended position, engaging the feature 122 of the adapter 104 once the adapter 104 is fully in place in the pocket 110.

As shown at FIGS. 2, 4, and 7-12, as an option in some implementations, the duty mount assembly 100 may also include one or more lock covers 202 (e.g., secondary locks), configured to cover the actuator(s) 124 while in the locked position (with the post 120 extended), and to protect the actuators 124 from being accidentally or unintentionally moved to the unlocked position. (Implementations without lock covers 202 are shown at FIGS. 1, 3, 5, and 6.)

Figure 8:
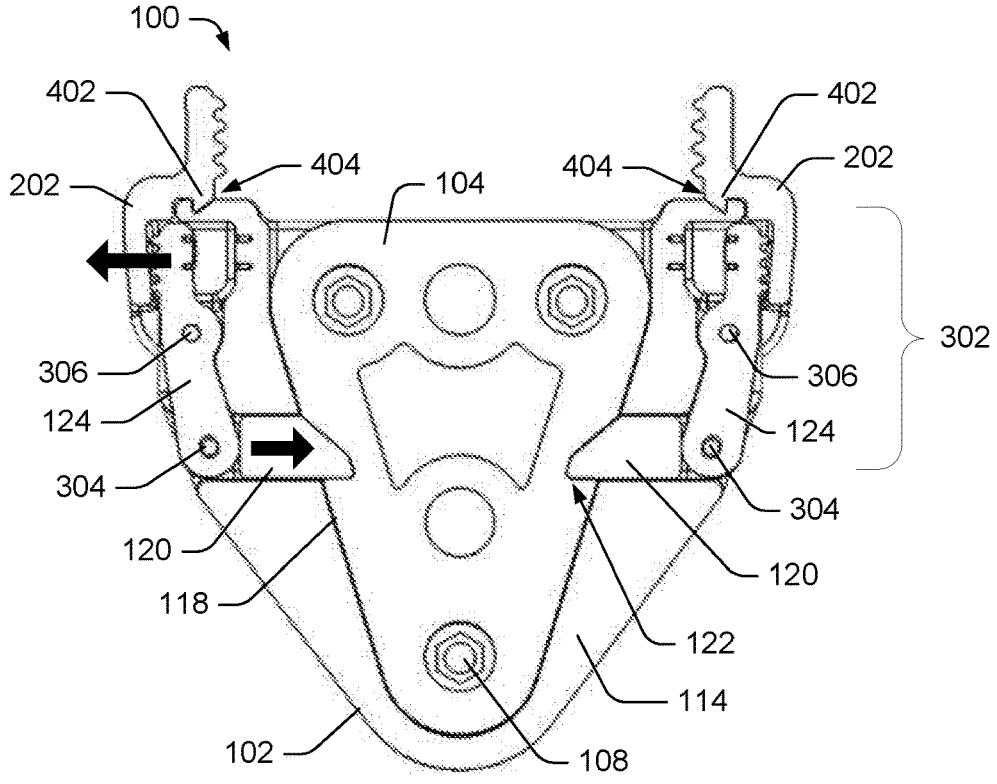
FIG. 8 shows a cross-section plan view of an example duty mount assembly with secondary locks in a locked configuration, according to an implementation.
Figure 10:
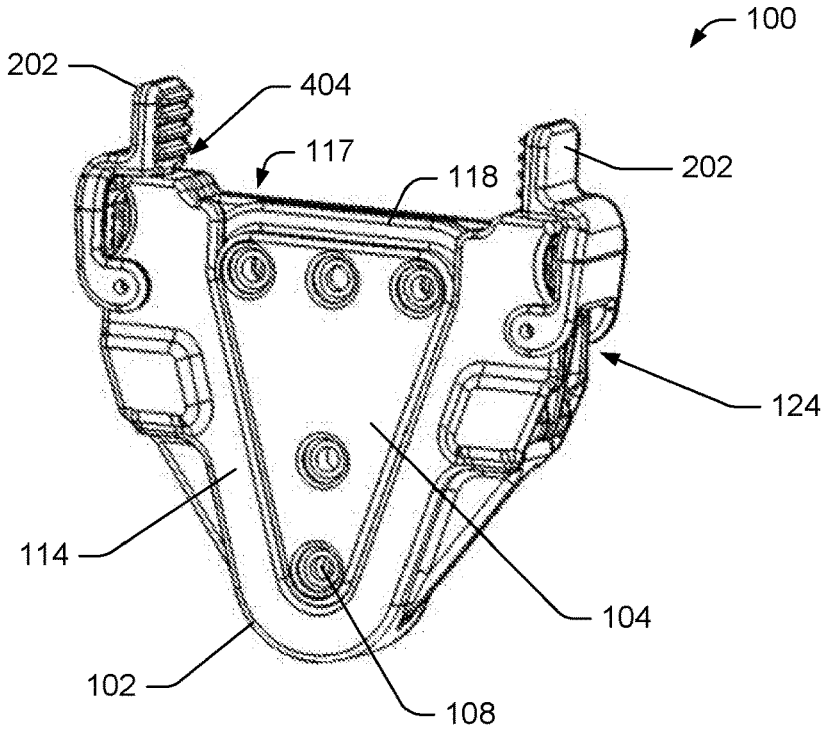
FIG. 10 shows a perspective view of an example duty mount assembly with secondary locks in a locked configuration, according to an implementation.
Figure 12:
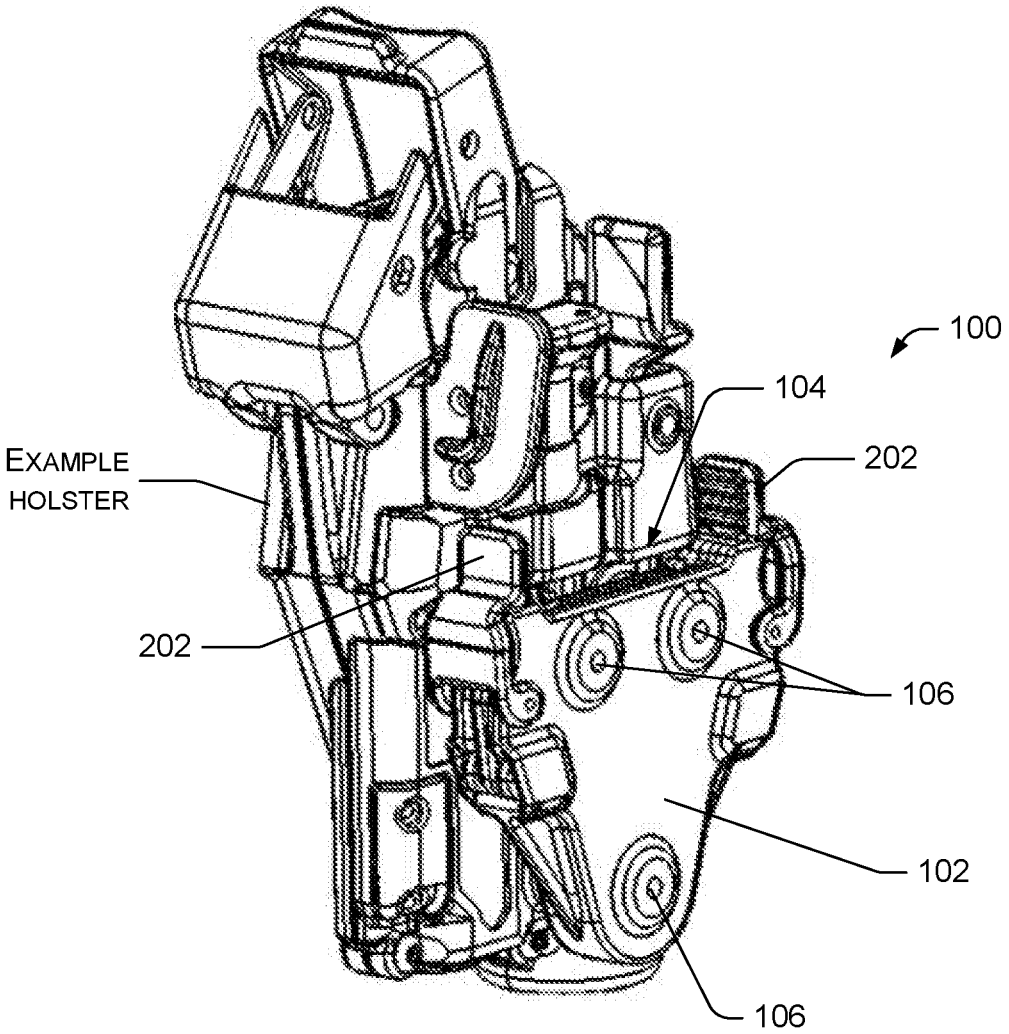
FIG. 12 is a perspective view showing an example of a holster mounted to a duty mount adapter, with the adapter locked into the receiver and the receiver in a locked configuration, according to an implementation.

The lock covers 202 can partly or fully cover the actuators 124, protecting the actuators 124 from unintentional contact, while the actuators 124 are in the locked configuration. For instance, the lock covers 202 may be pivotally or slideably coupled to the body of the receiver 102, and may be moved into the covered position (as shown in FIGS. 8, 10, and 12) when the adapter 104 is to be locked into the receiver pocket 110.

In various examples, the lock covers 202 comprise a pivotally coupled rigid covering, and may include one or more features 402 (such as one or more teeth, ridges, grooves, and so forth) configured to engage a mating feature 404 (such as one or more matching teeth, ridges, grooves, and so forth) on a portion of the receiver 102. The features 402 of the lock covers 202 may be engaged to the features 404 of the receiver 102 to secure the lock covers 202 into the locked position. For instance, the lock covers 202 may be snapped in place, or the like (as shown in FIG. 8, for example).

Figure 7:
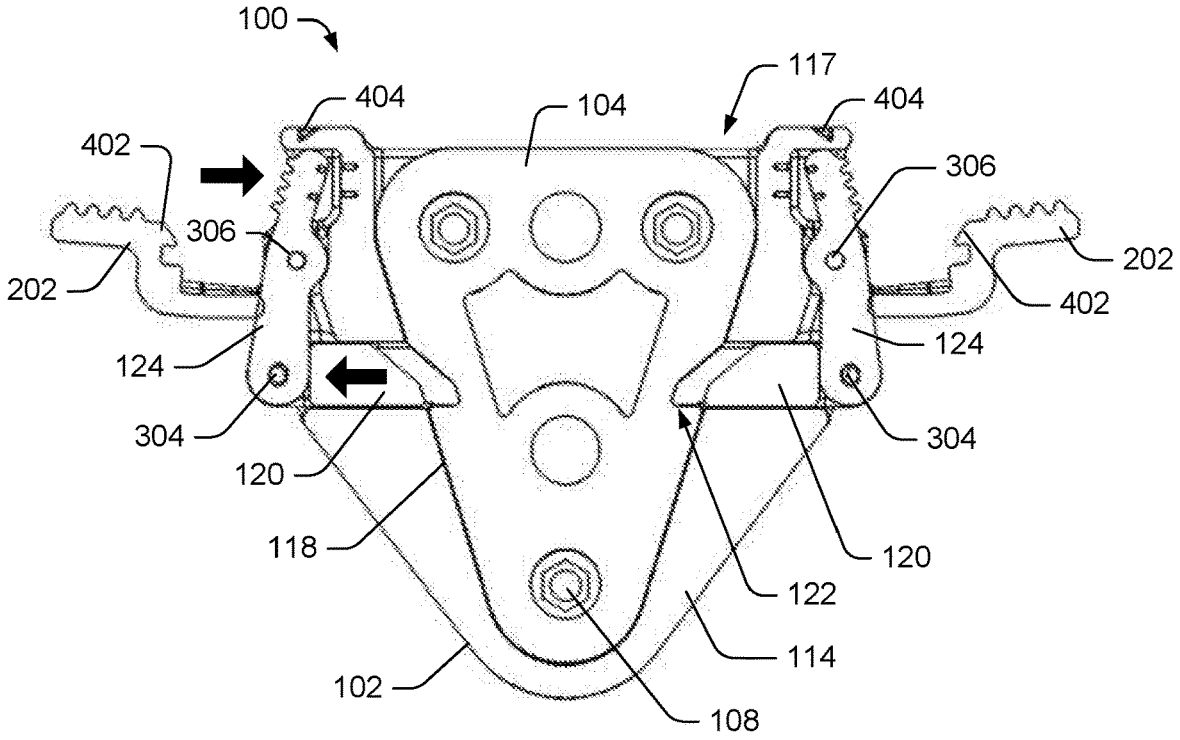
FIG. 7 shows a cross-section plan view of an example duty mount assembly with secondary locks in an unlocked configuration, according to an implementation.
Figure 9:
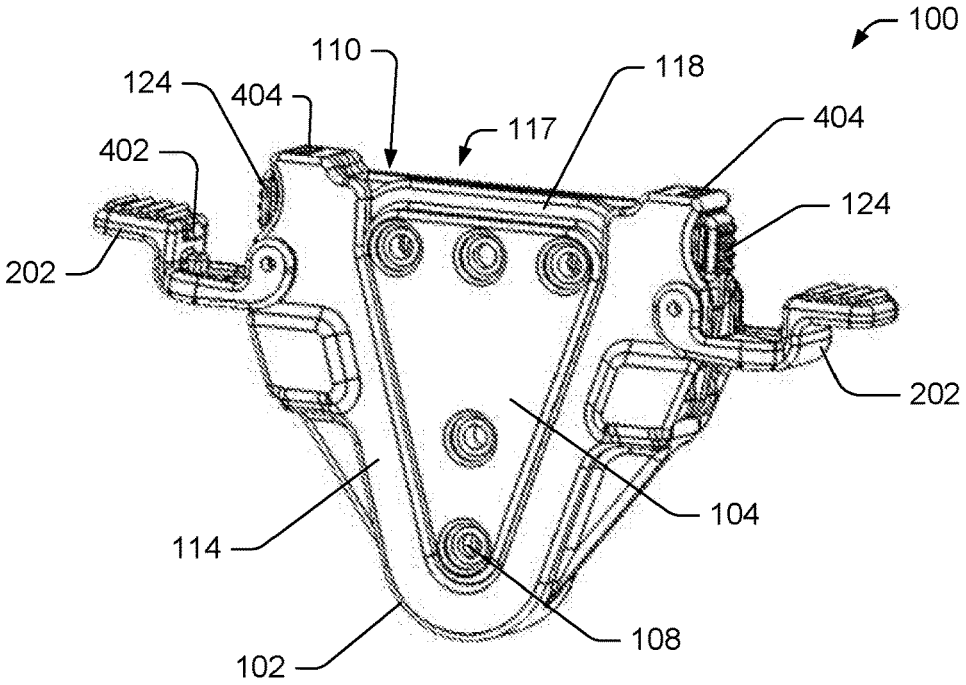
FIG. 9 shows a perspective view of an example duty mount assembly with secondary locks in an unlocked configuration, according to an implementation.
Figure 11:
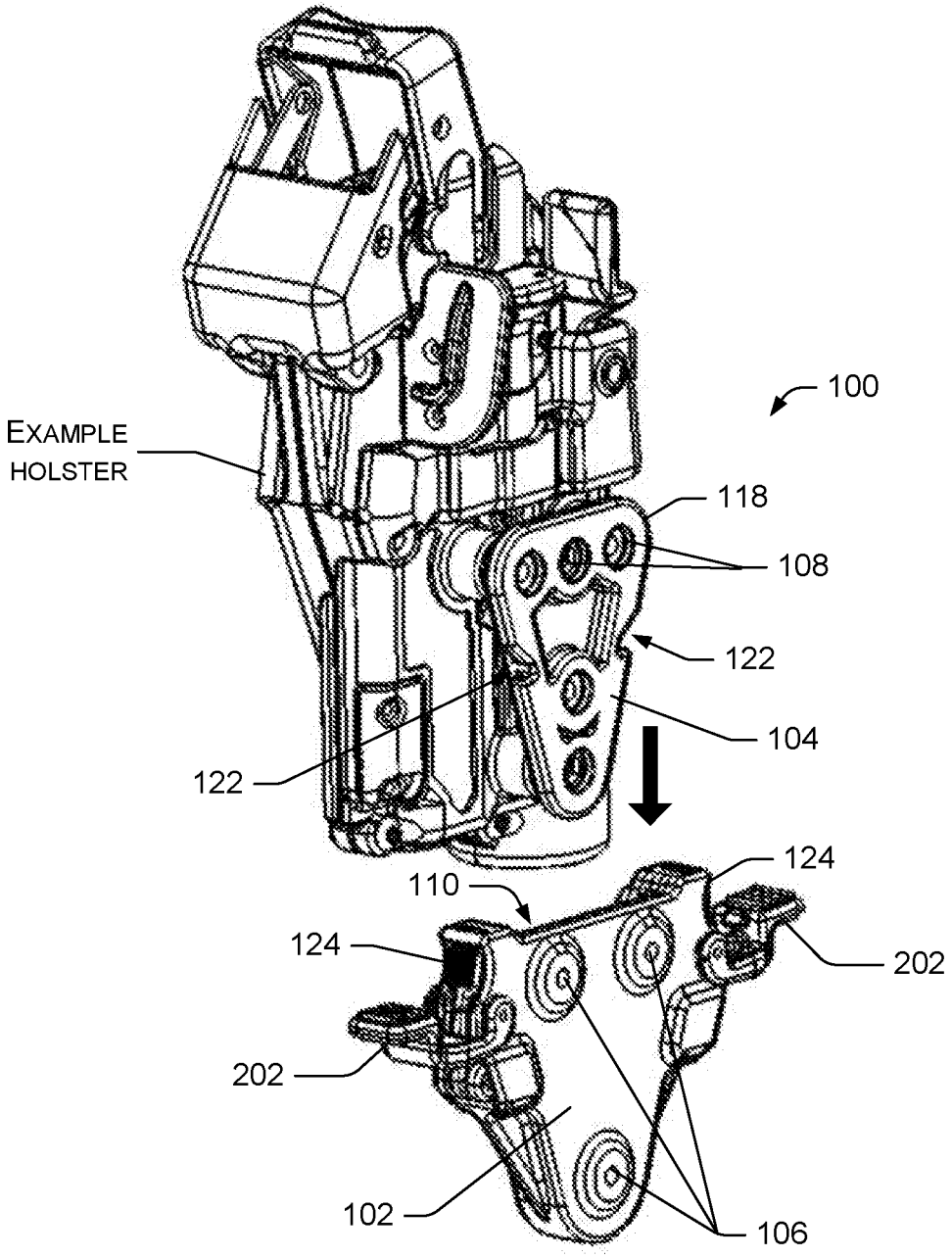
FIG. 11 is a perspective view showing an example of a holster mounted to a duty mount adapter, with a receiver in an unlocked configuration, according to an implementation.

To remove the adapter 104 from the receiver 102, the lock covers 202 (if present) are moved into the unlocked position (as shown in FIGS. 7, 9, and 11). This may include disengaging the features 402 of the lock covers 202 from features 404 of the receiver 102, for instance, and rotating, sliding, or otherwise moving the lock covers 202 out of the way of the actuators 124. The actuators 124 may then be moved to the unlocked configuration (by applying a force to the upper portion of the actuators 124 (as shown in FIG. 5, for instance), which retracts the posts 120, clearing the adapter 104 to be removed from the receiver 102. In various embodiments, this locking method can work with passive and active catch mechanisms 302, allowing for versatility in operation and application.

FIG. 11 is a perspective view showing an example of a holster (e.g., implement) mounted to a duty mount adapter 104. As shown in the illustration, the lock covers 202 of the receiver 102 are in an unlocked (open) position, when present and according to an implementation. The adapter 104 may be engaged to the receiver 102, as described above, while in this configuration.

FIG. 12 is a perspective view showing the example holster mounted to the duty mount adapter 104, while the adapter 104 is locked into the receiver pocket 110. The lock covers 202 of the receiver 102 and the catch mechanism 302 components are in the locked configuration.

The duty mount assembly 100 is discussed in terms of securing a holster, but the duty mount assembly 100 may be used to secure or mount any of various items, where secure mounting is desired. Although various implementations and examples are discussed herein, further implementations and examples may be possible by combining the features and elements of individual implementations and examples.

In various implementations, components of the duty mount assembly 100 are comprised of various plastics, composites, metals, combinations of the same, or the like. For example, the receiver 102 and/or the adapter 104 may be comprised of a polyamide, or similar material. For example, the duty mount assembly 100 components may be injection molded, stamped, formed, or the like. In various embodiments, the duty mount assembly 100 components have rigidity and stability properties based on a particular material selected for the duty mount assembly 100 components. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the duty mount assembly 100 components.

In various implementations, the duty mount assembly 100 may include fewer, more, or alternate components, and remain within the scope of the disclosure. In various embodiments, the shape and configuration of the duty mount assembly 100 components may vary to accommodate different implements or applications. In an example, the receiver 102 and/or the adapter 104 may be formed to closely fit a particular implement. In other examples, the receiver 102 and/or the adapter 104 may be more generally formed to fit multiple implements.

The illustrations of FIGS. 1-12 are not intended to be limiting. In the various example embodiments illustrated in FIGS. 1-12, the location and position of the components, locking mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a duty mount assembly 100 may be implemented as a stand-alone device or as part of another system (e.g., integrated with other components, such as a duty belt). In various implementations, additional or alternative components may be used to accomplish the disclosed techniques and arrangements.

Although various implementations and examples are discussed herein, further implementations and examples may be possible by combining the features and elements of individual implementations and examples.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A holster mounting assembly, comprising:

a receiver, including a substantially planar hard mount component arranged to be coupled to a holster belt, the receiver having a receiver pocket with a preselected perimeter shape, the receiver pocket formed by a frame disposed around at least a portion of a perimeter of the substantially planar hard mount component, the frame including a groove at an interior edge of the frame;

an adapter, comprising a substantially planar component arranged to be coupled to an implement or an implement holster, at least a majority portion of a perimeter of the adapter having the preselected perimeter shape of the receiver pocket, the adapter configured to be inserted into the receiver pocket and to securely fit within the receiver pocket, a perimeter edge of the adapter disposed within the groove of the frame when the adapter is within the receiver pocket, the perimeter edge of the adapter having at least one notch; and one or more catch mechanisms movably coupled to the receiver, each catch mechanism including:

a post slideably coupled to the receiver such that the post protrudes into the receiver pocket when in a locked configuration and does not protrude into the receiver pocket when in an unlocked configuration, the post configured to engage the notch of the adapter when in the locked configuration; and an actuator lever pivotally coupled to the post and pivotally coupled to the receiver such that pivoting the actuator lever a first direction slides the post into the unlocked configuration and pivoting the actuator lever a second direction slides the post into the locked configuration.

2. The holster mounting assembly of claim 1, further comprising one or more lock covers pivotally or slideably coupled to the receiver, each lock cover comprising a rigid covering configured to cover an actuator lever of the one or more catch mechanisms.

3. The holster mounting assembly of claim 1, wherein an area of the receiver pocket comprises a majority of an area of the receiver.

4. The holster mounting assembly of claim 1, wherein the frame comprises a raised portion that extends away from a back surface of the receiver and forms a ledge or bench around a portion of the perimeter of the back surface of the receiver.

5. The holster mounting assembly of claim 1, wherein the frame includes an opening at a top edge of the receiver, configured to allow the adapter to be moved into the receiver pocket through the opening.

6. The holster mounting assembly of claim 1, wherein the perimeter edge of the adapter has a thickness that is less than a thickness of an interior portion of the adapter, and wherein the thickness of the perimeter edge matches a thickness of the groove of the frame.

7. The holster mounting assembly of claim 1, wherein the preselected perimeter shape comprises a polygon with at least three vertices, and wherein the polygon is oriented relative to the receiver such that the adapter is led by one of the vertices when inserted into the receiver pocket.

8. The holster mounting assembly of claim 1, wherein the implement comprises a firearm and the implement holster comprises a holster for a firearm.

9. A mounting assembly, comprising:

a receiver, including a substantially planar hard mount component arranged to be coupled to a desired surface, the receiver having a receiver pocket with a preselected perimeter shape;

an adapter, comprising a substantially planar component arranged to be coupled to an object to be mounted, at least a majority portion of a perimeter of the adapter having the preselected perimeter shape of the receiver pocket, the adapter configured to be inserted into the receiver pocket and to securely fit within the receiver pocket; and one or more catch mechanisms movably coupled to the receiver, each catch mechanism including:

a post slideably coupled to the receiver such that the post protrudes into the receiver pocket when in a locked configuration and does not protrude into the receiver pocket when in an unlocked configuration, the post configured to engage a feature of the adapter when in the locked configuration; and an actuator lever pivotally coupled to the post and pivotally coupled to the receiver such that activating the actuator lever pivots the actuator lever in a first direction and slides the post into the unlocked configuration and releasing the actuator lever pivots the actuator lever in a second direction and slides the post into the locked configuration.

10. The mounting assembly of claim 9, further comprising one or more lock covers pivotally or slideably coupled to the receiver, each lock cover comprising a rigid covering configured to cover an actuator lever of the one or more catch mechanisms.

11. The mounting assembly of claim 9, further comprising a frame disposed around at least a portion of a perimeter of the substantially planar hard mount component, the frame including a groove at an interior edge of the frame.

12. The mounting assembly of claim 11, wherein a perimeter edge of the adapter is disposed within the groove of the frame when the adapter is within the receiver pocket.

13. The mounting assembly of claim 11, wherein the groove comprises a guide for the adapter, the groove arranged to guide the adapter into the receiver pocket.

14. The mounting assembly of claim 9, wherein the post and/or the actuator lever are biased to move the post into the locked configuration.

15. The mounting assembly of claim 14, wherein the post is moved out of the receiver pocket by the adapter when the adapter is inserted into the receiver pocket and the post is in the locked configuration, and wherein the post returns to protruding into the receiver pocket when the adapter is fully within the receiver pocket.

16. A mounting assembly, comprising:

a receiver, including a substantially planar hard mount component having mounting holes arranged to couple the receiver to a desired surface, the receiver having a receiver pocket with a preselected perimeter shape;

an adapter, comprising a substantially planar component having mounting holes arranged to couple the adapter to an object to be mounted, a portion of a perimeter of the adapter having the preselected perimeter shape of the receiver pocket, the adapter configured to be inserted into the receiver pocket and to securely fit within the receiver pocket; and one or more catch mechanisms movably coupled to the receiver, each catch mechanism including:

a post slideably coupled to the receiver such that the post protrudes into the receiver pocket when in a locked configuration and does not protrude into the receiver pocket when in an unlocked configuration, the post configured to trap the adapter within the receiver pocket when in the locked configuration; and an actuator lever mechanically coupled to the post and to the receiver such that activating the actuator lever moves the post into the unlocked configuration and releasing the actuator lever moves the post into the locked configuration.

17. The mounting assembly of claim 16, further comprising a raised frame disposed around at least a portion of a perimeter of the substantially planar hard mount component, the frame including a groove at an interior edge of the frame, wherein a perimeter edge of the adapter is disposed within the groove of the frame while the adapter is inserted into the receiver pocket and when the adapter is within the receiver pocket.

18. The mounting assembly of claim 17, wherein the frame includes an opening at a top edge of the receiver, configured to allow the adapter to be moved into the receiver pocket through the opening.

19. The mounting assembly of claim 17, wherein the post is arranged to protrude into the receiver pocket through an opening in the frame when in the locked configuration.

20. The mounting assembly of claim 16, wherein the post is biased to engage a feature of the adapter when in the locked configuration, and wherein the actuator lever is pivotally coupled to the post and pivotally coupled to the receiver.

* * * * *